United States Patent [19]

Anderson

[11] Patent Number: 4,867,403

[45] Date of Patent: Sep. 19, 1989

[54] OVERHEAD SHEET-INSTALLATION SUPPORT TOOL

[76] Inventor: Paul C. Anderson, 143 Maple Ave., Chester, N.J. 07930

[21] Appl. No.: 230,305

[22] Filed: Aug. 9, 1988

Related U.S. Application Data

[63] Continuation-in-part of Ser. No. 209,924, Jun. 22, 1988, abandoned.

[51] Int. Cl.[4] ..... E04G 3/00

[52] U.S. Cl. ..... 248/216.1; 52/DIG. 1; 414/11

[58] Field of Search ..... 248/323, 216.1, 217.4; 269/102; 411/409, 400, 401, 919; 81/DIG. 1, 180.1, 487; 254/131, 8 R; 414/11; 52/DIG. 1

[56] References Cited

U.S. PATENT DOCUMENTS

| | | | |
|---|---|---|---|
| 889,925 | 6/1908 | Hampton | 248/267 |
| 933,831 | 9/1909 | Steiger | 411/403 |
| 3,143,219 | 8/1964 | Aldrich | 414/11 |
| 4,158,455 | 6/1979 | Brown | 269/102 |
| 4,571,902 | 2/1986 | Liebetrau | 52/DIG. 1 X |
| 4,709,527 | 12/1987 | Cooley | 52/DIG. 1 X |
| 4,826,390 | 5/1989 | Paxton | 414/11 |

*Primary Examiner*—J. Franklin Foss
*Attorney, Agent, or Firm*—William T. Hough

[57] ABSTRACT

For temporarily supporting an end of one sheet and/or of adjacent ends of two separate sheets of plasterboard (drywall), plywood or the like, in a raised overhead state and position while raising and securing opposite end(s) thereof to overhead rafters, beams or the like, there is provided an overhead sheet-installation support tool inclusive of a forwardly-directed tapered threaded screw having a longitudinal axis along its length-dimension with a tapered forward distal end, having at its forward distal end screw threads; there is a handle structure extending rearwardly a suitable height-distance for grasping and handling, the handle having opposite flattened sides spaced-apart by a minor handle-thickness, and with forward shoulders of handle structure having laterally-extending shoulders angled rearwardly at laterally outwardly distal ends thereof and the shoulders having a flange along at-least a forward edge of the shoulders with the flange extending at an angle of about 90 degrees relative to the flattened spaced-apart sides, and an arcuate flat-faced support member being mounted adjustably on one of the flattened sides positioned and adapted to be intermittently adjusted such that an end thereof is moveable to and from a lower face of a support beam and/or ceiling located in juxtaposition to an outer end portion of one of the laterally-extending shoulders, and a linear flat-faced support element adjustably mounted on one of the flattened sides positioned to length-wise extend and be adjusted in along a direction extending substantially parallel to the a longitudinal axis of a shaft or shank portion of the threaded screw such that an upper flattened end of the linear flat-faced support element is movable to and from position(s) of support of a sheet-support level at which desirably a sheet would be thereby be locked-against a beam while being nailed or otherwise secured to the beam.

17 Claims, 1 Drawing Sheet

FIG. 1
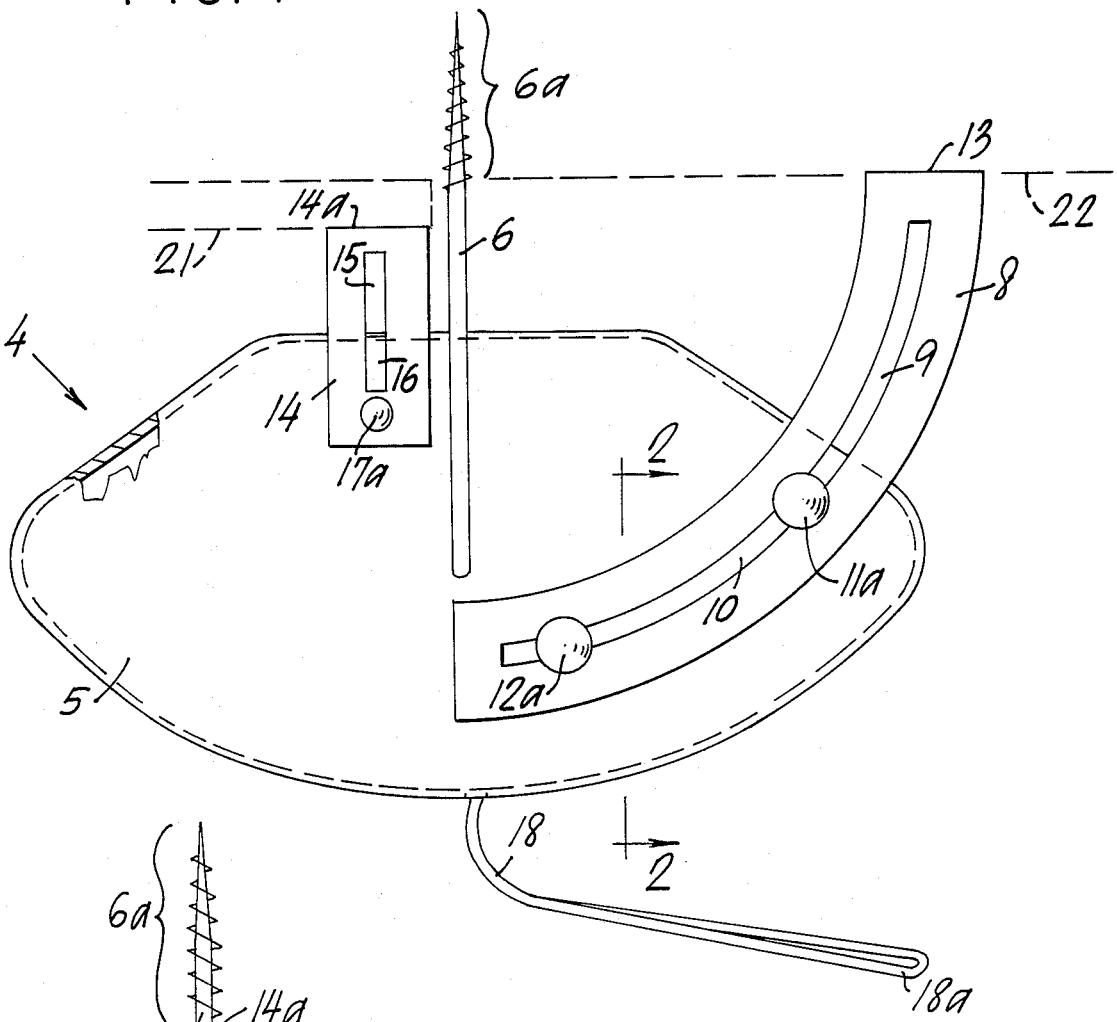
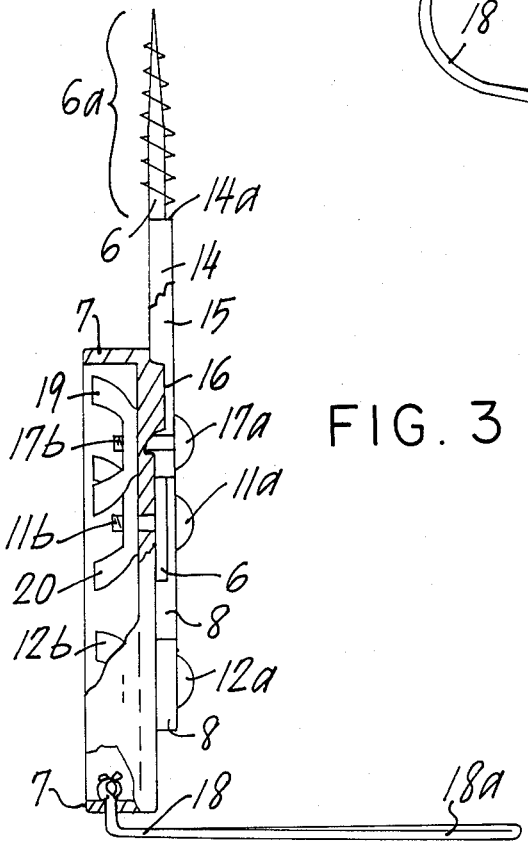
FIG. 3
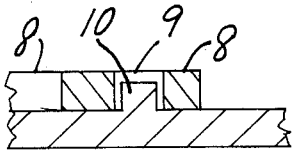
FIG. 2

OVERHEAD SHEET-INSTALLATION SUPPORT TOOL

This invention is directed to an improved overhead sheet-installation support tool to assist a workman in the installation of overhead drywall (sheetrock), plywood or the like ahd is a continuation-in-part of and incorporated by reference the entire disclosure of the same inventor's copending patent application U.S. Ser. No. 209,924 filed June 22, 1988, now abandoned.

PRIOR ART

While no relevant prior art was located by the inventor, prior non-analagous patents having no bearing on the invention, and distinguished in the language of the claimed invention, include the following. U.S. Pat. No. 933,831 to DeSteiger re a machine screw having an insertable handle-accessory; U.S. Pat. No. 889,925 to Hampton and Eagle regarding a shade roller bracket by virtue of a shade-rod key-receiving slot-configuration in one of a pair of shade-mounts, and a shade-rod shaft-receiving hole in the second member of the pair, each of the shade-mount including a forward-end screw for the permanent-mounting of the pair; and U.S. Pat. No. 4,158,455 to Brown for a jig member for holding a planar sheet material during installation.

BACKGROUND

Installation of ceiling materials has previously been a difficult task generally involving two or more people and wooden supports called "T-bars", or cumbersome and expensive hydraulic or mechanical lifts. T-bars and lifts are even more difficult to use when applying sheetrock to the underside of rafters. Typically previoulsy for the installation of sheetrock (for typically installing as a ceiling), commonly referred to as "drywall", two or more persons are required, at-least one person to hold-up (support) one end while the opposite end is being tacked to the overhead beam. Use of T-bars or the like does not diminish the need and requirement of two or more workmen to do the job. Accordingly, the cost in installaton, requiring special expensive devices and/or more than one person, typically two or more persons working together to assure non-slipping and accuracy of and during installation, is esculated to time charges eventually borne by the contractor or home-buyer or the like, i.e. by the consuming public. The support tool of the inventor's above-noted copending U.S. Ser. No. 209,924 while achieving great success in acutal us on the job has been found to be subject to excessive torque forces causing the screw shaft or shank to bend and/or break after during and/or after repeated use thereof, because of the large weight supported by the laterally-extending forwardly-positioned shoulder(s) of the support tool, particularly when there is the frequently-occuring situation of a sheet being supported on one of the shoulders but not on the other remaining shoulder of the support tool.

OBJECTS OF THE INVENTION

Accordingly, a primary object of the invention is to overcome problems and difficulties of the types discussed-above, particularly the above-noted torque-problem that served to cause bending and/or breakage of the shank or shaft of the screw when anchor in an overhead beam and supporting a sheet on one shoulder thereof.

Another object is to provide a mechanism in combination with the support member, for temporarily locking a sheet into a position against a beam's lower or side face (as the caae may be) to allow opportunity for a person working-along, to secure the sheet with less difficulty.

Another object is to obtain an overhead sheet-installation support tool achieving the foregoing object and making possible high quality installation devoid of complicated or expensive devices and devoid of helpers beyond a single, individual installing worker.

Another object is to achieve the foregoing objects together with facilitating "lining" a deteriorating plaster ceiling with sheetrock.

Another object is to obtain an accessory installation tool easily adjustable to vary required or desired distance for suspension from an overhead support, as required or desired for sheets of different thicknesses and for installations requiring different working-room, and the like.

Another object is to facilitate ease in the supporting of a sheet in very close proximity to a ceiling or beam to which the sheet is to be secured, during measuring and thereafter intermittent cutting and refitting or remeasuring and/or attaching the sheet, during the installation process.

Another object is to obtain a device which may be used with assured safety, devoid of any substantial degree of hazard or not "holding" while supporting hevy sheetrock or other comparable sheet material.

Another object is to provide a sheetrock-mounting accesory tool of a configuration faciliating easy handling, availability and use during the installation.

Other objects become apparent from the preceding and following disclosure.

SUMMARY OF THE INVENTION

The invention may be broadly described as an overhead sheet-installation support tool having a tapered screw tapering from a proximal end to a distal end; the tool has laterally-extending forwardly-positioned shoulder(s) and handle structure(s). The tool has rearwardly-extending handle structure that may or may not be combined with the shoulder-structure above-described; in any event, the combined dimensions of the laterally-extending shoulder(s) and handle structure(s) extend rearwardly at-least sufficiently graspable and to forcefully manually finger twist the tool screwably into beams, rafters or the like. The handle structure has at-least one face thereof critically substantially flattened (noting that minor curvature would be acceptable), and of the above-noted width and rearward extension dimensions. The handle's rearwardly-extending flattened lateral surface(s) critically extend(s) in a plane substantially parallel with and substantially aligned with the longitudinal axis of the screw—essential, such that the handle structure with its/their flattened face(s) (surface(s)) necessarily do(es) not interfere with, i.e. provides free-space in juxtaposition thereto for moving past the flattened lateral surface an end of a rigid sheet-structure. The laterally extending shoulder structure(s)'s forwardly positioned side-surface(s) likewise critically extend in a plane substantially parallel to and aligned with the flattened lateral suface such that, again, the one or more flange(s)'s side surface(s) is/are positioned to provide free-space in juxtaposition thereto for moving past said one forwardly-directed flange side surface an end of a rigid sheet structure toward a forward (upward) mounting position for a rigid sheet structure. In a greatly improved embodiment, there are critically included one or more adjustable flat-faced support members mounted with a flat-face thereof aginst one of the flat faces of the handle structure, mounted adjustably securable for intermittent locking and loosening intermittently and for adjusting an end thereof intermittently toward, to and alternately away from a level of support-beam or ceiling as a brace opposite side of the screw's shank. This (these) adjustable support member(s) critically prevent the bending or breaking of the shaft or shank of the screw by countering the torque caused by a sheet being supported on an oppositely-extending shoulder of the support tool, and is/are in juxtaposition to one of spaced-apart rearwardly-extending sides of the handle-structure.

In another preferred embodiment, there is provided one or more support elements that preferably is/are critically positioned in a location close to the shank in order to reduce torque(s) on the screw shaft or shank, this support element being a linear element having at-least one flat face thereof adujstably mounted flushly against one of the flat faces of the handle structure, positioned and intermittently adjustable to be intermittently moved upwardly toward and alternately from, a locking position for pressing onto a lower surface of a supported sheet sufficiently to lock the sheet into a position against a beam or ceiling lower or side surface (as the case may be) or damage a lower face of the sheet supported thereon.

The screw preferably contains at least a major amount of hardened steel—desirable for enduring stress and strain of repeated screwing into beams, removing, and bearing-up durably and safely while supporting heavy loads.

Preferaby each or both of opposite shoulders has a forward leading edge angled rearwardly from a laterally-extending perpendicular "zero" degrees up to a critical maximum number of degrees of about ten degrees, angling rearwardly as the shoulder(s) extend(s) rearwardly; this facilitates and/or makes possible the position of the shoulders beneath an elevated end of a raised end of a rigid sheet-structure by revolving of the handle structure while concurrently the flange(s) provide(s) stable support for mounting thereupon a raised end of a rigid sheet-structure.

In a further preferred embodiment, the combined rearwardly-extending height of the flange(s) and handle structure ranges between about one-fourth inch up to about eight inches as measured from the forwardly-directed flange side surface above-noted, providing maximum benefits discussed in prior paragraphs.

In another preferred embodiment, the thread angle ranges from about 44 to 46 degrees for a practical combination of adequate holding, speedy insertion, and easy insertion of the screw by revolving while applying moderate forward pressure thereto against the rafter or beam or the like.

The preferred screw has a total length—inclusive of tapered portion and the shank or shaft, sufficient to provide adequate working room and sufficient screw-holding depth, and to allow for sheets of varying different thicknesses, ranging from a practical minimum of about one and one-half inches to about three inches.

Likewise, preferably for the best combined holding capability, with easy insertion, the screw has from about seven to nine threads per inch.

Preferably for making possible the mounting of adjacent sheet-ends supported in juxtaposition, the handle structure and shoulders structure (which may or not be combined into a single integral structure), each and both have opposite (i.e. two) flattened surfaces or faces. Also, having each of opposite sides flattened, makes it possible to optionally turn either flat face toward a space through which a sheet end will be lifted past the tool to a location above the soulder(s) forward side surface (on which the sheet end will be supported).

For normal conventional operations, while providing a desired and preferred margin of safety against potential hazard of accidental slipping of a sheet from the supported position on a forwardly-directed shoulder side surface, the rearward angle above-discussed preferably ranges from about two degrees to a maximum of about five degrees.

The shoulder structure extends laterally in each of opposite directions, to provide two, alternate or selectable forwardly-directed side surfaces of the two oppositely-extending shoulder structures, again providing for the supporting concurrently of adjacent ends of two spaced-apart sheetrock sheets, for example.

More preferably, mounted within a through-space hole in the handle or flange thereto, is a cord-head, with a single cord extending from one side of the handle structure's hole, and the single cord having a free-end continuous with and/or mounting a wrist-loop. Thereby, when the wrist-loop is mounted around a worker's wrist while revolving the handle and accordingly while revolving the screw—as would occur during the screw-mounting within a lower face of a wooden rafter or wooden beam, the single cord, held in the through-space hole by virtue of the cord-head (or equivalent head structure), will revolve within the through-space hole, preventing the cord from becoming twisted and from cramping or tightening the wrist-loop mounted on the worker's wrist.

In a most optimum embodiment, the inventive overhead sheet-installation support tool may be described as follows: an overhead sheet-installation support tool inclusive of a forwardly-directed tapered threaded screw having a longitudinal axis along its length-dimension with a tapered forward distal end of a length of about two and one-fourth inches, having at its forward distal end screw threads of about 45 degrees with about eight threads per inch; the screw is made of substantially hardened #2 grade steel; there is a handle structure extending rearwardly a height distance of about three inches as measured from the rearward-proximal end of the screw, the handle having opposite flattened sides spaced-apart by a handle-thickness of about three-eights inch, with a width dimension of about five inches, forward shoulders of handle structure being laterally-extending shoulders angled reawardly at laterally outwardly distal ends thereof, with the arcuate adjustable support having an elongated slot through which space-apart bolts are inserted and anchored and adjustably intermittently lockable through spaced-apart holes in a flat face of the handle structure typically and preferably by manually tightenable wing nuts respectively, and likwise the linear support has an elongated slot through which one or more bolts is/are likewise adjustably intermittently lockable to one of the flat faces of the handle structure.

The mounting position during use is illustratively depicted in FIG. 1 of the above-noted parent application.

The invention may be better understood by making reference to the followig figures.

THE FIGURES

FIG. 1 diagrammatically and symbolically illustrates a face-on side view of the most preferred embodiment of the present invention.

FIG. 2 diagrammatically and symbolically illustrates a view taken along line 2—2 of FIG. 1, illustrating the elongated key structure on which additionally the slotted arcuate member rides.

FIG. 3 diagrammatically and symbolically illustrates an edge-view of the embodiments of FIGS. 1 and 2, with partial cut-aways showing the bolts extending through bolt-hole apertures in the flat-faced handle structure, and also in partial cut-away showing the cord attachment through the flange-hole.

DETAILED DESCRIPTION

FIGS. 1 through 3 disclose a common embodiment embodying all preferred features, and accordingly use common indicia for corresponding parts, where illustrated in more than one figure.

With particular reference to all figures, there is disclosed the most optimum preferred embodiment. There is shown the sheet-mounting support tool 4, inclusive of the integral structure that combines the handle structure 5 and the flange structure 7. Integrally and rigidly connected to and extending forwardly from the handle structure 5, is the screw 6 inclusive of its distal tapered threaded end 6*a*. The above-noted sidewardly-directed flange 7 extends in a direction defining an angle of about 90 degrees relative to the flat face shown in elevation plan view in FIG. 1 for the handle structure 5. In the handle-portion of the integral flange structure 7, a single cord 18 with an enlarged head is mounted through an aperture or hole in the flange 7, and having loop cord 18*a* through which a person's wrist would normally be inserted. Diagrammatically, the screw 23 is shown with to screw's distal end and threads thereof screwed-into and thereby mounted within a lower face symbolically of a wooden beam or rafter 22 shown in phantom. FIG. 1 further illustrates a preferred arcuate member 8 adjustably mounted and locked onto shafts of bolts 12*a* and 11*a* that extend through the arcuate slot 9. Likewise the arcuate key 10 extends through the slot 9. Accordingly the preferably flat end 13 of the arcuate member 8 is shown in it typical operational position and state, braced supportingly against the lower surface of the symbolically illustrated beam or the like, such that weight and/or pressure of the sheet 21 (symbolically represented) that is illustrated as supported in a pinned-state against the lower surface of the beam 22, by the upper preferably flat end 14*a* of the linear element 14. the linear element 14 rides on a shaft of the bolt 17*a* extending through the linear slot 15 in the same manner as the arcuate member 8 riding on the shafts of bolts 11*a* and 12*a*. The linear member 14 likewise rides on the key element 16 extending integrally upwardly from the handle structure 5 the same as the arcuate key 10 for slot 9.

The screw 6 is attached to the handle structure 5 typically by conventional electric welding, but may be attached by other mechanisms.

FIG. 2 illustrates an in-part view take along line 2—2 of FIG. 1, illustrating the relationship of the arcuate member and its slot 0 to the arcuate elongated key 10.

FIG. 3 illustrate substantially the same member and elements as that of FIGS.1 and 2, but showing greater detail in cut-away portions. Additionally, there are shown the threaded bolt-ends typically such as 11*b* and 17*b* having wing nuts mounted on bolts such as wing nuts 12*b*, 19 and 20. It is noted that also in this FIG. 3, in order to better illustratively show the position of the screw slot 15, a portion of the linear element 14 is shown with partial cut-away.

Accordingly, by the present invention, an overhead sheet-installation support tool is disclosed and described, having opposite flat faces on the handle portion, rigidly integral with forwardly-directed screw, characterized as above-described, for temporarily supporting and/or pinning into nailing-position one end of a rigid or substantially rigid sheet such as sheetrock or plywood or the like, and/or concurrently on the oppositely-extending shoulder having the end 13 of the angular member 8 braced against the lower surface 22 in order to thereby provide support against torque and bending or breaking pressures on the screw 6. During the supporting of one or more sheets, as above-noted, the tool is temporarily screwed into the overhead rafter or beam or ceiling or the like.

Normal mounting for installing a drywall ceiling typically of four-foot-wide sheets, is typically as described in the parent application, repeated in-part hereinbelow, together with further description of use of the present inventive improvements, for convenience and understanding by the public, as follows, merely symbolic and to improve a working understanding.

Snap calk line across joists (rafters, furring strips, or the like) approximately 48 and three-eights inch from the wall. When using on rafters, start from a bottom wall. Make sure the line is at least 48 and on-eighth inch from the wall at all points. If not, restrike the line. Put the wrist loop of the tool around your wrist and screw straight into the joist in the center of the chalk line by both pushing upwardly and concurrently turning (revolving) the tool. The screw starts easily and should penetrate at least five-eights inch, but not so (too) much that the drywall will not fit between the joist and the tool's forwardly-directed sheet-supportable side-face above-described. Use two tools positioned (located) beside the sheets (i.e. in this instance, not necessarily at the exact end of the sheet) located approximately one and ½ feet to 2 feet from either (each) end of the each 8 1 foot sheet. Use three or four tools for longer sheets. Leave the tools, as mounted, in "standby" positions—i.e. turned such that the flange and handle structure do not interfere with the lifting of the sheet(s) past and to a location-above the flange(s), extending (as mounted) perpendicularly downwardly from the joist(s), parallel with long (tapered) edges of the drywall (sheetrock) sheet. After screwing-in the screw the appropriate depth, the wing nuts are loosened for the arcuate member 8 and the end 13 is raised to a bracing-position in contact with a lower surface of the beam (or ceiling, as the case may be). After raising a sheet from a position supported on the tools shoulder and flange 7, to a nailing position and state, the appropriate wing nut is loosened for the liner element 14 and end 14*a* is raised to a pinning position and state after which the wing nut thereto is tighted such that the end 14*a* holds the sheet 21 in a pinned state against the lower surface of the beam 22.

Other procedure described in the parent application may likewise be followed.

It is within the scope of this invention to make such variations and modifications and substitution of equivalents as would be apparent to a person of ordinary skill in this art.

I claim:

1. An overhead sheet-installation support tool comprising in combination: a forwardly-directed tapered threaded screw having a longitudinal axis along its length-dimension and having a forwardly-located distal end and a reawardly-enlarged proximal end, the screw being tapered toward and at its forwardly-located distal end and said distal end having male screw threads; a handle structure extending rearwardly from said rearwadly-enlarged proximal end, said handle structure having at-least one rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a righd sheet-structure toward a forward mounting position for a rigid sheet-structure; and shoulder-forming structure forming at-least one forwardly-positioned shoulder structure rigidly continuous with at-least one of said screw and said handle structure, the one shoulder structure extending laterally to said longitudinal axis of the screw and said one forwardly-positioned shoulder structure extending in a plane substantially parallel to and aligned with said flattened lateral surface such that the one flange side surface is positioned to provide free-space in juxtaposition thereto for moving past said one forwardly-positioned shoulder structure toward a forward mounting position for a rigid sheet-structure; the one forwardly-positioned shoulder structure and the handle structure jointly extending rearwardly sufficiently to be graspable and to allow forceful manual finger-twisting thereof to screw said screw into a beam or rafter; and at least one manually adjustable support member having at least one member-flat face mounted with the member-flat face parallel to and secured against said flattened lateral surface, said support member having a first distal end and being intermittently adjustable and intermittently immovably securable in different positions and positioned in a mounted state such that said first distal end is movable forwardly of said one forwardly-positioned shoulder structure toward and to be braceable against structure above said one forwardly-positioned shoulder structure when adjusted forwardly.

2. The overhead sheet-installation support tool of claim 1, in which said handle structure has spaced-apart rearwardly-extending edges, and in which said manually adjustable support member is mounted at a position spaced-away from said screw in juxtaposition to one of said spaced apart edges such that said first distal end thereof is spaced-away from said screw.

3. The overhead sheet-installation support tool of claim 2, in which said manually adjustable support member has a member-longitudinal axis and is arcuate along said member-longitudinal axis thereof.

4. The overhead sheet-installation support tool of claim 3, including a support element having a second distal end and being intermittently adjustable and intermittently immovably securable in different positions along said element-longitudinal axis and positioned such that said second distal end is movable forwardly of said one forwardly-positioned shoulder structure toward and to be braceable against structure above said one forwardly-positioned shoulder structure, said support element mounted at a position spaced-away from said spaced-apart rearwardly-extending edges in juxtaposition to screw such that said second distal end thereof is in juxtaposition to said screw when adjusted forwardly.

5. The overhead sheet-installation support tool of claim 4, in which said support element includes an element-longitudinal axis and in which said support element is linear along said element-longitudinal axis.

6. The overhead sheet-installation support tool of claim 5, in which said first distal end is substantially flat in a direction extending substantially transversely to said member-longitudinal axis.

7. The overhead sheet-installation support tool of claim 6, in which said second distal end is substantially flat in a direction extending in a direction transversely to said member-longitudinal axis.

8. The overhead sheet-installation support tool of claim 1, in which said distal end is substantially flat.

9. The overhead sheet-installation support tool of claim 4, in which said second distal end is substantially flat.

10. The overhead sheet-installation support tool of claim 7, in which said handle structure has opposite ones of said rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure.

11. The overhead sheet-installation support tool of claim 10, in which said screw comprises hardened #2 grade steel.

12. The overhead sheet-installation support tool of claim 1, in which said handle structure has opposite ones of said rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure.

13. The overhead sheet-installation support tool of claim 1, in which said screw comprises hardened #2 grade steel.

14. The overhead sheet-installation support tool of claim 1, including a through-space hole formed in said handle structure included a rearwardly-positioned flange extending sidewardly and having an aperture therethrough, and including a wrist-mounting loop and headed-cord thereto, and said headed-cord being mounted in said aperture, whereby the single cord will freely revolve in said through-space hole whenever said screw and handle structure are revolved while the wrist-mounting loop in mounted on a person's wrist.

15. The overhead sheet-installation support tool of claim 1, including first mounting means for mounting said support member onto said handle structure, said support member includig a through-slot extending along a length of the support member with the through-slot extending through said one member-flat face, and said first mounting means including a first headed bolt having a threaded shaft, and said mounting means including at least one first female-threaded wing-nut, one of said first female-threaded wing-nut being mountable onto each said first threaded shafts.

16. The overhead sheet-installation support tool of claim 4, including second mounting means for mounting said support element onto said handle structure, said support member including a through-slot extending along a length of the support element with the through-slot extending through said one member-flat face, and said second mounting means including a second headed bolt having a threaded shaft, and said mountingmeans including at least one second female-threaded wing-nut, one of said second female-threaded wing-nut being mountable onto each said second threaded shafts.

17. An overhead sheet-installation support tool comprising in combination: a forwardly-directed tapered threaded screw having a longitudinal axis along its length-dimensions and having a forwardly-located distal end and a reawardly-enlarged proximal end, the screw being tapered toward and at its forwardly-located distal end and said distal end having male screw threads; a handle structure extending rearwardly from said rearwadly-enlarged proximal end, said handle structure having at-least one rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure; and shoulder-forming structure forming at-least one forwardly-positioned shoulder structure rigidly continuous with at-least one of said screw and said handle structure, the one one shoulder structure extending laterally to said longitudinal axis of the screw and said one forwardly-positioned shoulder structure extending in a plane substantially parallel to and aligned with said flattened lateral surface such that the one flange side surface is positioned to provide free-space in juxtaposition thereto for moving past said one forwardly-positioned shoulder structure toward a forward mounting position for a rigid sheet-structure; the one forwardly-positioned shoulder structure and the handle structure jointly extending rearwardly sufficiently to be graspable and to allow forceful manual finger-twisting thereof to screw said screw into a beam or rafter; and at least one manually adjustable support ekement having at least one member-flat face mounted with the member-flat face parallel to and secured against said flattened lateral surface, said support element having a first distal end and being intermittently adjustable and intermittently immovably securable in different positions and positioned in a mounted state such that said first distal end is movable forwardly of said one forwardly-positioned shoulder structure toward and to be braceable against structure above said one forwardly-positioned shoulder structure when adjusted forwardly, said handle structure having spaced-apart rearwardly-extending edges, and said support element being mounted at a position spaced-away from said spaced-apart rearwardly-extending edges in juxtaposition to screw such that said first distal end thereof is in juxtaposition to said screw when adjusted forwardly.

* * * * *